United States Patent [19]

Arnström et al.

[11] 4,242,829

[45] Jan. 6, 1981

[54] CONNECTING DEVICE

[76] Inventors: Anders P. Arnström, Generalsvägen 80, S-184 02 Österskär; Lennart K. Dahlgren; Britt I. Dahlgren, both of Utsiktsvägen 10, S-436 00 Askim, all of Sweden

[21] Appl. No.: 954,229

[22] Filed: Oct. 24, 1978

[30] Foreign Application Priority Data

Oct. 13, 1978 [SE] Sweden ..... 7810717

[51] Int. Cl.[3] ..... A63H 23/00; E04D 13/00; F16B 7/18; F16B 7/04

[52] U.S. Cl. ..... 46/91; 46/31; 403/DIG. 4; 403/363; 403/300; 52/11

[58] Field of Search ..... 46/92, 91, 31; 104/73; 405/122; 403/DIG. 4, 363, 300; 61/14; 52/11

[56] References Cited

U.S. PATENT DOCUMENTS

| | | | |
|---|---|---|---|
| 1,014,975 | 1/1912 | Poehlman | 46/91 |
| 3,302,949 | 2/1967 | Wolfe | 46/91 |
| 3,355,895 | 12/1967 | Bayes et al. | 52/11 |
| 3,837,116 | 9/1974 | Sun | 46/220 |

*Primary Examiner*—Gene Mancene
*Assistant Examiner*—Michael J. Foycik, Jr.
*Attorney, Agent, or Firm*—Birch, Stewart, Kolasch & Birch

[57] ABSTRACT

A device for providing a waterproof connection between two separate sections of a water canal in a toy kit. In that connection a connecting element with transversal sealing strips is used said element principally having a U-shaped section.

2 Claims, 2 Drawing Figures

CONNECTING DEVICE

This invention refers to a device for providing a waterproof connection between two sections or a water canal in a toy kit, said device including a connecting element having transversal sealing strips and an essentially U-shaped cross-section. A toy kit of the type in connection with which this invention is mainly intended for use is described more in detail in Swedish patent application No. 7604440-3.

In a toy kit of the mentioned kind several different components or parts are included which can be combined by joining to provide a desired canal system which may also include canal locks, basins and/or water-wheels, for example.

Now the main object of this invention is to provide a connecting device by which the components included in the kit will be connectable by simple means and by use of a slight force in order to provide joints which completely waterproof. According to the invention this can be obtained in a device of the kind specified in the preamble by providing gripping snap elements in pairs, opposite to each other at the outer portions of the flexibly bendable legs of the connecting elements, each snap element then including a curved guiding surface facing a corresponding guiding surface of the opposite element of the corresponding pair of snap elements so that the essentially U-shaped section ends of the water canal sections are insertable between the guiding surfaces of the corresponding pair of snap elements for locking within the connecting element under the gripping snap elements.

The invention will now be described more in detail in connection with a preferred embodiment and with reference to the enclosed drawings.

Figure 1:
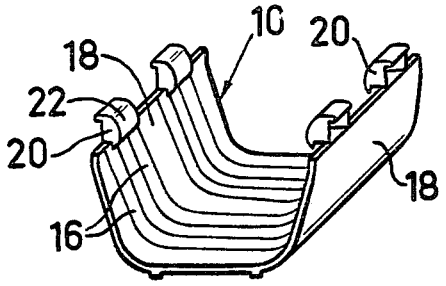
FIG. 1 shows a perspective view disclosing a connecting element having the features of the invention.
Figure 2:
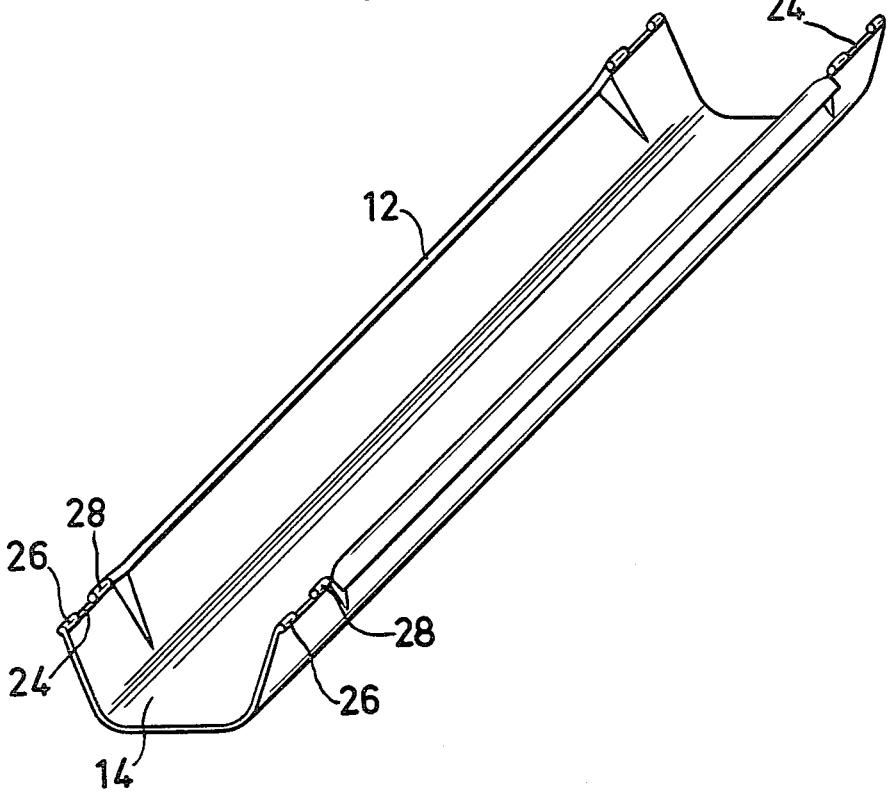
FIG. 2 shows a perspective view disclosing a canal section which may be included in a toy kit in which the new connecting device may be used.

The new connecting element 10 and those ends 14 of the building components 12 to be connected opposite to each other essentially have the same U-shaped cross-section. The connecting element 10 is a relatively short conduit section in which the ends 14 of the components are mountable, preferably with a space therebetween. In that connection sealing strips 16 are used and said strips are located transversal to the connecting element in such a way that said strips are sealingly brought to engagement against the underneath side of the ends, respectively, of the components. Preferably the connecting element 10 is produced from an elastic hard plastic so that the side walls or the legs 18 thereof may be elastically pressed outwards. At the outer portions of the legs 18 of the connecting element 10 there are so called snap elements 20. In the disclosed embodiment there are two pairs of snap elements and each pair includes two elements mounted opposite to each other on the two legs. By locating, as already mentioned, the ends 14 of the components with a space therebetween in the connecting element 10, said components may be mounted inclined relative to each other. This is of advantage particularly when the support is not completely flat.

Each one of the snap elements 20 includes a curved guiding surface 22 so located that it faces the corresponding guiding surface of the other element in the pairs, respectively, of snap elements. At the upper portion of the snap element 20 the guiding surface is inclined or curved downwards-inwards relative to the connecting element and at the lower portion said guiding surface is inclined or curved downwards-outwards. By such a design a component end 14 may be forced into the connecting element 10 the corresponding edge portions 24 then being adapted to be locked under two corresponding snap elements 20. By the particular design of the snap element the component end 14 at first will easily be inserted between the elements. However, the movement is stopped or reduced when the lower portion of the component end abuts the sealing strips. At this stage, however, the corresponding edge 24 has already reached the corresponding downwards-outwards extending guiding surface portion of the snap element 20 and a slight pressing urges the edge 24 in place under the snap element 20. Preferably this is provided by a thumb grip and the force is applied on either side of the adjacent U-legs of the connecting element 10 and the component 12. In connection with the mounting it has been found suitable first to insert one leg of the component end under a snap element and then to press the other leg of the element in place under the corresponding snap element utilizing said thumb grip.

At both ends of the kit component 12 disclosed on the drawing and at a corresponding leg edge there are two enlarged sections 26 and 28. The intention is to have the snap element 20 grip the leg edges 24 between said enlarged sections 26, 28. Thereby a firm and safe connection is obtained and the components cannot be separated from each other unless the snap elements 20 of the corresponding pair of elements are pressed apart.

Suitable also, the end of the components is elastically compressible. Hereby the step of mounting and dismounting the components is simplified.

Of course the device disclosed on the drawing may be modified in different ways. The number of snap elements may be varied and the shape of the guiding surfaces may be modified within wide limits. Such variations are not to be regarded as a departure from the spirit and scope of the invention, and all such modifications as would be obvious to one skilled in the art are intended to be included within the scope of the following claims.

We claim:

1. A device for providing a waterproof connection between two sections of a water canal in a toy kit which comprises a connecting element having substantially a U-shaped cross-section, wherein the legs of the U-shaped element are elastically bendable, said connecting element having transversally positioned sealing strips on the inner face thereof, at least two pairs of gripping snap elements provided opposite each other at the outer portions of said elastically bendable legs of the connecting element, each of said snap elements including a curved guiding surface facing a corresponding guiding surface of the opposite member of the respective pair of snap elements such that the end of a similarly U-shaped canal section may be inserted between the guiding surfaces of said snap elements for locking with said connecting element under said gripping snap element.

2. A device according to claim 1, characterized in that that portion of the guiding surface of the snap element facing the connecting element inclines towards the adjacent leg thereof.

* * * * *